US010077624B2

(12) United States Patent
Doane

(10) Patent No.: US 10,077,624 B2
(45) Date of Patent: Sep. 18, 2018

(54) GRIPPING ARRANGEMENT

(71) Applicant: James Doane, Friendswood, TX (US)

(72) Inventor: James Doane, Friendswood, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 0 days.

(21) Appl. No.: 15/214,202

(22) Filed: Jul. 19, 2016

(65) Prior Publication Data

US 2018/0023357 A1 Jan. 25, 2018

(51) Int. Cl.

| | |
|---|---|
| ***E21B 33/128*** | (2006.01) |
| ***E21B 23/01*** | (2006.01) |
| ***E21B 33/129*** | (2006.01) |
| ***E21B 33/12*** | (2006.01) |

(52) U.S. Cl.

CPC ..... *E21B 33/128* (2013.01); *E21B 23/01* (2013.01); *E21B 33/12* (2013.01); *E21B 33/129* (2013.01); *E21B 33/1293* (2013.01)

(58) Field of Classification Search

CPC ..... E21B 33/12; E21B 33/129; E21B 33/128
See application file for complete search history.

(56) References Cited

U.S. PATENT DOCUMENTS

| | | | | |
|---|---|---|---|---|
| 4,044,826 | A | 8/1977 | Crowe | |
| 5,046,557 | A * | 9/1991 | Manderscheid | E21B 33/1295 166/120 |
| 5,727,632 | A | 3/1998 | Richards | |
| 6,119,774 | A | 9/2000 | Doane et al. | |
| 6,241,017 | B1 | 6/2001 | Doane et al. | |
| 6,715,560 | B2 * | 4/2004 | Doane | E21B 23/01 166/122 |
| 7,387,170 | B2 | 6/2008 | Doane et al. | |
| 8,550,177 | B2 * | 10/2013 | Henckel | E21B 33/129 166/125 |
| 8,561,687 | B2 | 10/2013 | Moore et al. | |
| 2016/0061001 | A1 | 3/2016 | Fitzhugh et al. | |
| 2016/0251922 | A1 | 9/2016 | Eldho et al. | |

FOREIGN PATENT DOCUMENTS

WO 2015080751 A1 6/2015

OTHER PUBLICATIONS

Overview of "Premier Removable Production Packer—Isolate zones with permanent packer performance and multiple retrieval options"; Baker Hughes, 2011; www.bakerhughes.com; 2 pages.

Notification of Transmittal of the International Search Report and the Written Opinion of the International Searching Authority, or the Declaration; PCT/US2017/042495; dated Nov. 6, 2017: 12 pages.

* cited by examiner

*Primary Examiner* — D. Andrews
*Assistant Examiner* — Tara E Schimpf
(74) *Attorney, Agent, or Firm* — Cantor Colburn LLP

(57) ABSTRACT

An embodiment of a gripping arrangement includes a mandrel having an axially extending groove therein, a first slip ring about the mandrel, a first cone about the mandrel spaced from the first slip ring, and a key engaged with the groove such that the key is axially movable and rotationally fixed relative to the mandrel. The key is disposed to maintain the spacing between the first slip ring and the first cone. The gripping arrangement also includes a release feature releasably interconnected with the key and method.

12 Claims, 8 Drawing Sheets

GRIPPING ARRANGEMENT

BACKGROUND

Setting and unsetting of downhole tools is a common activity in the hydrocarbon exploration and recovery industry. Also due to the many different kinds of tools to be set and unset, there are various iteration of the setting and unsetting arrangements to support the goal. While many exist and function well for their intended purposes, it is also always a desire in the industry to improve efficiency, reduce cost and or improve function of all downhole tools. Arrangements then that reduce length, reduce unwanted motion in favor of facilitating wanted motion and combining functions are all desirable to the art.

SUMMARY

An embodiment of a gripping arrangement includes a mandrel having an axially extending groove therein, a first slip ring about the mandrel, a first cone about the mandrel spaced from the first slip ring, and a key engaged with the groove such that the key is axially movable and rotationally fixed relative to the mandrel. The key is disposed to maintain the spacing between the first slip ring and the first cone. The gripping arrangement also includes a release feature releasably interconnected with the key.

An embodiment of a gripping arrangement includes a mandrel having an axially extending groove therein, a first slip ring about the mandrel, a first cone about the mandrel spaced from the first slip ring, and a key engaged with the groove and configured to be loaded to unset the gripping arrangement.

An embodiment of a method for unsetting a gripping arrangement including a mandrel having an axially extending groove therein, a first slip ring about the mandrel, a first cone about the mandrel spaced from the first slip ring, and a key engaged with the groove such that the key is axially movable and rotationally fixed relative to the mandrel. The key is disposed to maintain the spacing between the first slip ring and the first cone. The gripping arrangement also includes a release feature releasably interconnected with the key the arrangement further including a second slip ring and, a second cone interactive with the second slip ring, the method including pulling on the second slip ring and the mandrel, increasing distance the second slip ring and the second cone, shifting the mandrel relative to the key, contacting the key on a shoulder of the groove, moving the first cone with the key away from the first slip ring.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
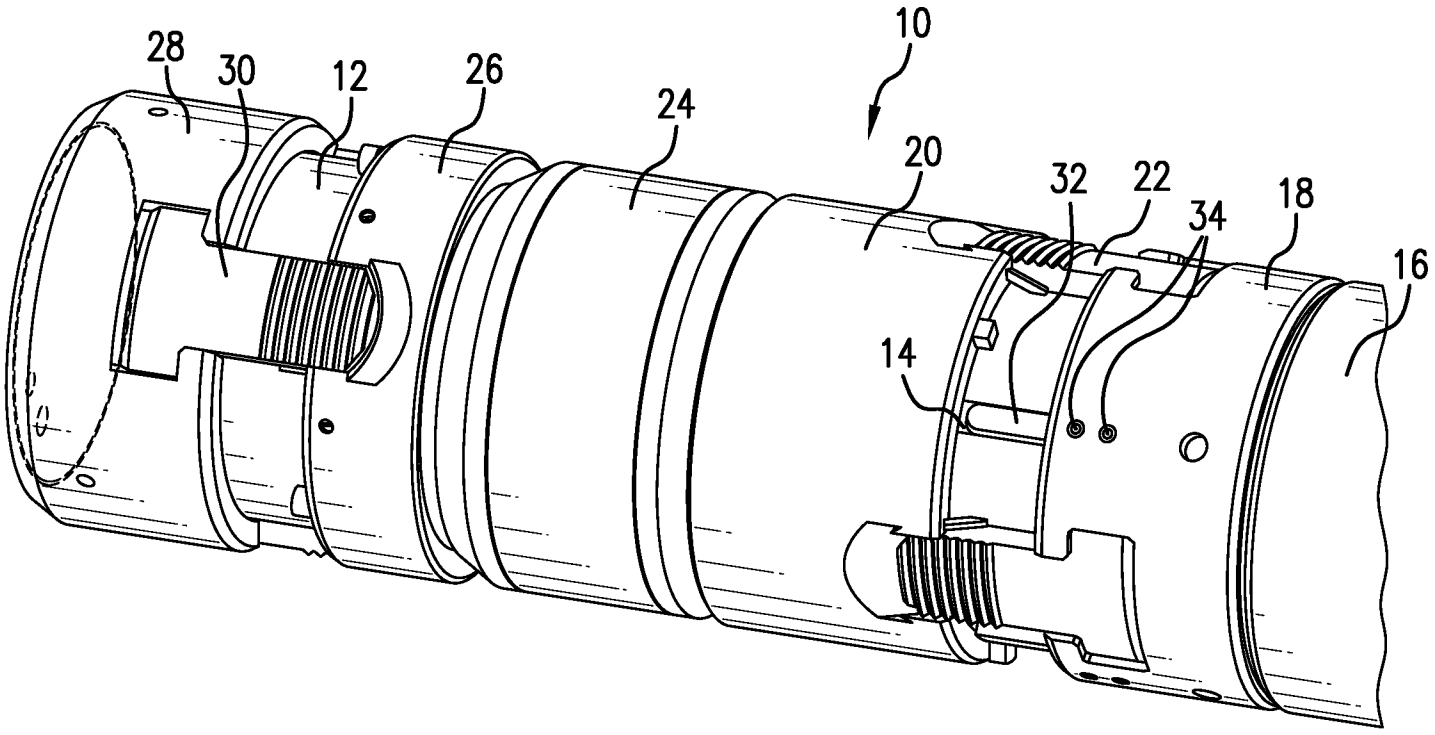
FIG. 1 is a perspective view of an embodiment of a gripping arrangement as disclosed herein.

Referring to FIG. 1, a perspective view of a gripping arrangement 10 is illustrated. The arrangement 10 includes a mandrel 12 that extends through other components of the arrangement that are introduced hereunder. The mandrel 12 includes a groove 14 therein that has varying lengths in different embodiments, to be discussed hereunder (see FIG. 2). Upon the mandrel 12 are (arbitrarily introduced from downhole end to uphole end) a piston housing 16; a first slip ring 18; a first cone 20; slips 22; seal 24; second cone 26; second slip ring 28 and slips 30. Also visible is key 32 and release feature 34. The key 32 enables setting of the gripping arrangement without unwanted movement of the mandrel 12 relative to a structure 36 such as a casing string (see FIG. 2) in which the gripping arrangement is to be set. This is accomplished by delaying the setting of the slips 22 due to an interfering condition the key 32 instigates between the first slip ring 18 and the first cone 20. More specifically, the key 32 prevents the slip ring 18 being urged nearer the first cone 20 until other conditions precedent are met. This, then, prevents the interaction of the slips 22 with the cone 20 to move slips 22 radially outwardly into engage the structure 36. The delay in engagement of slips 22 ensures that the slips 30 will engage the structure first. Engaging slips 30 first provides reliable location of the gripping arrangement 10 in the structure 36. The key 32 is also beneficial in the unsetting operation also discussed more fully hereinafter. Finally, key 32 inhibits rotational movement of the mandrel 12 relative to other components of the gripping arrangement 10. FIG. 1 and the foregoing information will provide one of ordinary skill in the art an overview for visual perspective while reviewing the following discussion wherein additional components are introduced and discussed.

FIGS. 2-6, cross sectional views of the embodiment of FIG. 1 allow for the introduction of some additional components not visible in FIG. 1 and to provide a sequence view illustrating the setting and unsetting movements of the gripping arrangement 10.

Figure 2:
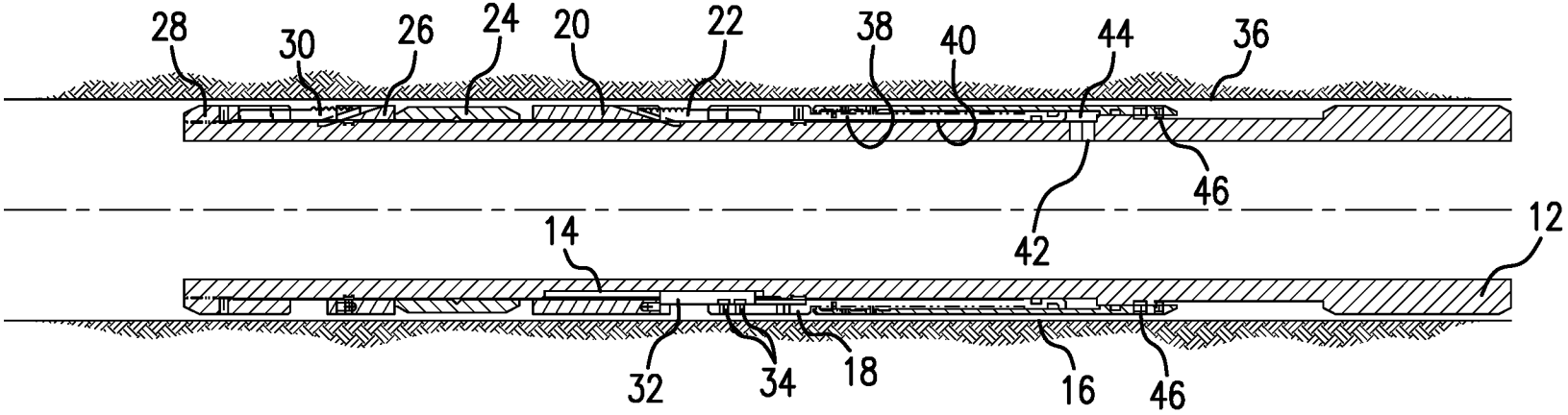
FIG. 2 is a cross section view of the embodiment of FIG. 1 in a run in condition.

Referring to FIG. 2, a body lock ring 38 of piston housing 16 is shown. This feature is embodiment specific in that the illustrated embodiment employs hydraulic pressure to set the arrangement 10. Due hereto, the slip ring 18 includes a piston 40 extending therefrom or at least in contact therewith (in an embodiment where the piston 40 is a separate member from the first slip ring 18). Pressure through port 42 acts on chamber 44 and hence piston 40 to urge the piston and the first slip ring 18 in the direction of second slip ring 28. The body lock ring 38 prevents relative movement of the piston housing 16 and the piston 40 in a direction opposite the direction the applied hydraulic pressure urged the piston. It will also be noted that piston housing 16 is attached to the mandrel 12 through a releasable attachment 46, such as shear screws, whose function it is to allow for movement of mandrel 12 to unset the gripping arrangement at a later time.

Figure 3:
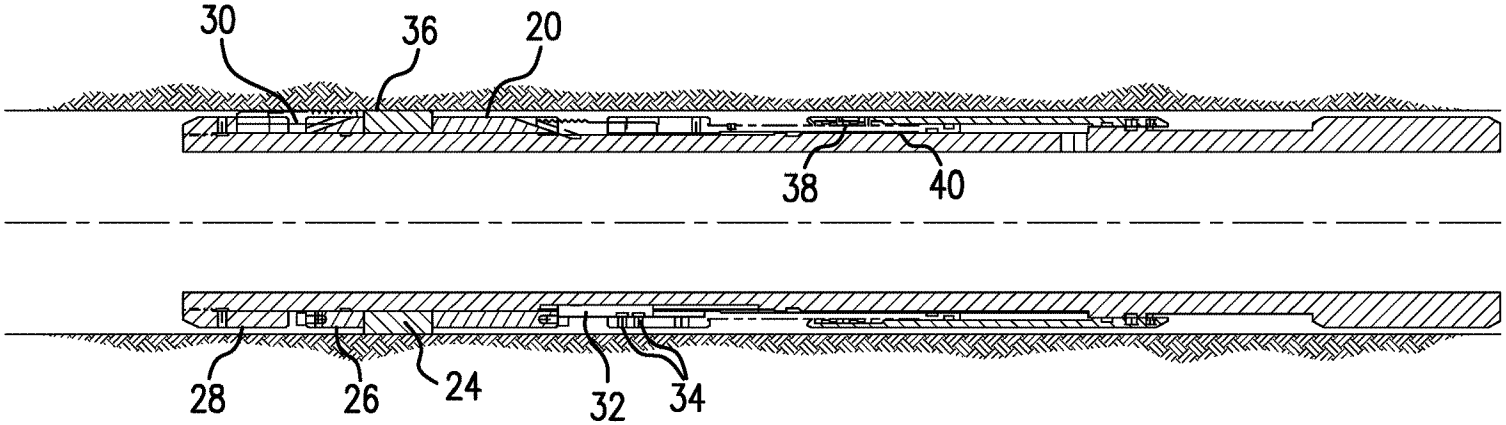
FIG. 3 is a cross section view of the embodiment of FIG. 1 in a partially set condition.

Moving to FIG. 3, it can be seen that the piston 40 has moved a distance toward the second slip ring 28, due to fluid pressure enlarging the chamber 44. During this movement, the force generated by fluid pressure is transferred through the piston 40, the first slip ring 18, the release feature 34, the key 32, the cone 20, the seal 24 and the second cone 26 to cause the slips 30 to interact with the second cone 26 and move radially outwardly into engagement with the structure 36.

Once the slips 30 bite into the structure 36, the second cone 26 becomes essentially immobile and the force generated from the piston 40 is taken up by the seal 24. In the case of a compression element, seal 24 is compressed and radially expanded into sealing contact with the structure 36. As the seal 24 fills any void spaces, it becomes immobile since in the compression seal embodiment it is inherently incompressible and the first cone 20 becomes consequently immobile.

Figure 4:
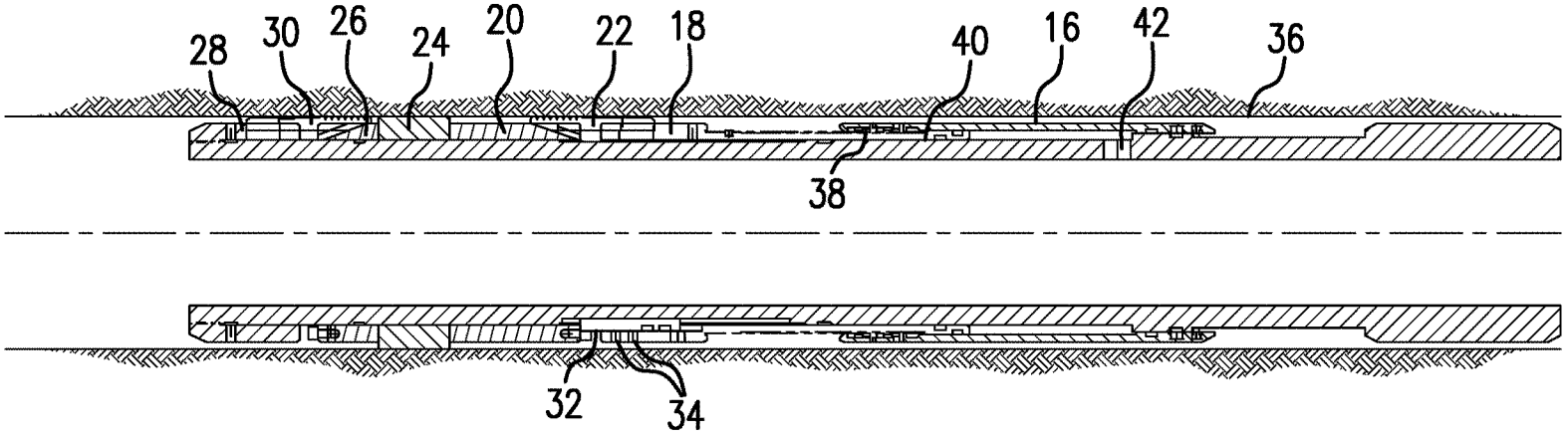
FIG. 4 is a cross section view of the embodiment of FIG. 1 in a fully set condition.
Figure 4A:
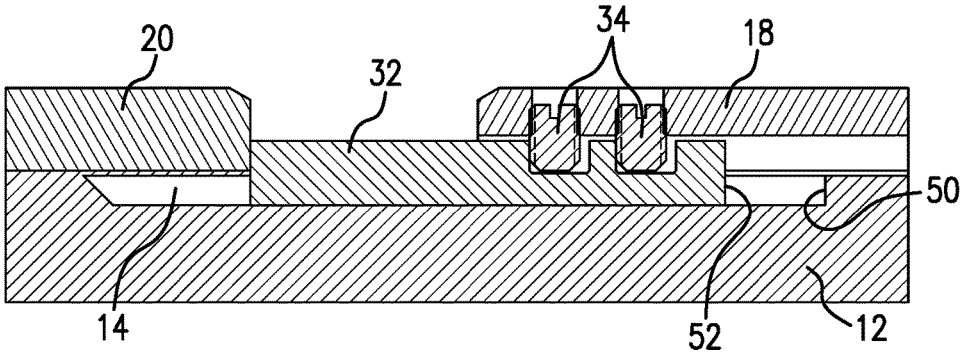
FIG. 4*a* is an enlarged view of a portion of the embodiment of FIG. 1.

Referring to FIG. 4, force from the piston 40 is pitted against the immobile first cone 20 loading the key 32 and the release feature 34, which in the illustrated embodiment attaches the key to the first slip ring 18. FIG. 4*a* is a detail view of the key 32 in the groove 14 in one embodiment. It is noted that in this embodiment the groove extends underneath the cone 20 hence requiring the cone is axially longer for the embodiment than it would have to be for the alternate embodiment illustrated in FIG. 7. Once a release threshold is achieved, the release feature 34 releases (as illustrated shear screws shear) and the first slip ring 18 is free to move into greater proximity with the first cone 20. Resultantly, the slips 22 interact with the first cone 20 moving radially outwardly into contact with the structure 36. The gripping arrangement 10 will remain set in this position until further intervention is taken.

Figure 5:
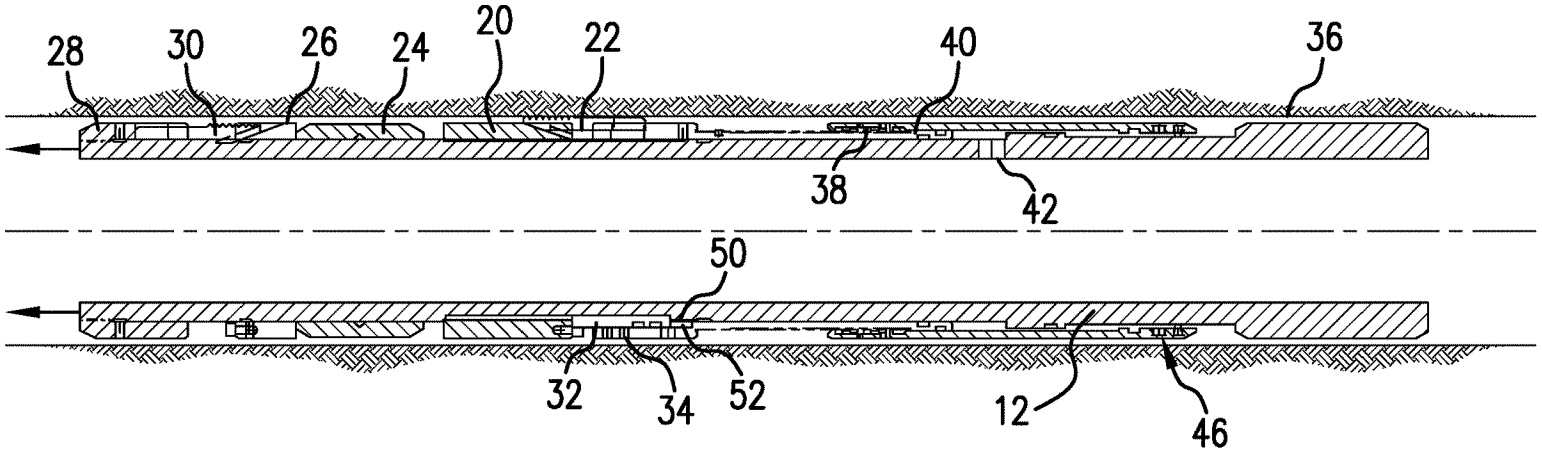
FIG. 5 is a cross section view of the embodiment of FIG. 1 in a partially unset condition.
Figure 6:
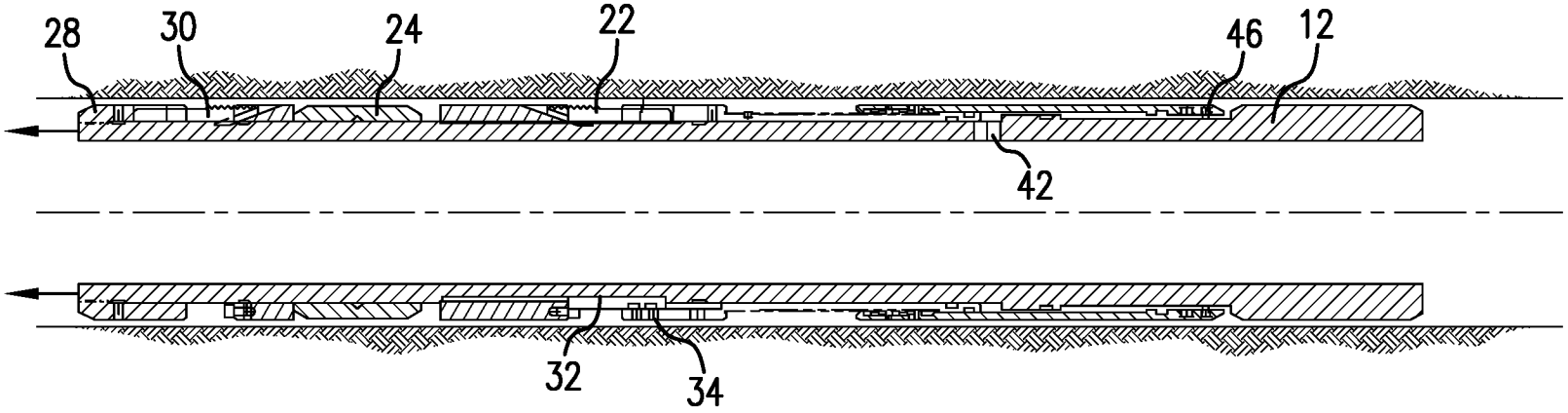
FIG. 6 is a cross section view of the embodiment of FIG. 1 in a fully unset condition.

Referring to FIG. 5, in order to unset the gripping arrangement 10, a straight pull on the second slip ring 28 or mandrel 12 is all that is necessary. The first action to occur subsequent to application of a tensile force on the gripping arrangement 10 through the second slip ring 28 or the mandrel 12 is that releasable attachment 46 will release at a selected force. This allows the mandrel 12 to move leftwardly in the figures sliding on piston 40. Next, the slips 30 are pulled down the second cone 26 and out of engagement with the structure 36. The energy trapped in the seal 24 will then dissipate upon additional movement of the mandrel in the leftward direction of the figures hereof. As a shoulder 50 of groove 14 (see FIG. 4*a*) contacts end 52 of key 32, the key 32 is moved leftwardly into forced contact with first cone 20 (see FIG. 6) thereby unsupporting the slips 22. At this point the gripping arrangement 10 is unset and may be moved.

Figure 7:
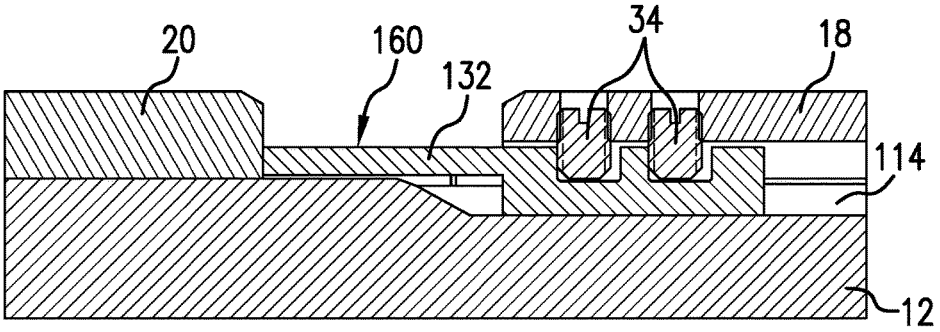
FIG. 7 is an enlarged view of a portion of an alternate embodiment, the figure being the equivalent of FIG. 4*a* in the FIG. 1 embodiment.

In an alternate embodiment, referring to FIG. 7, a key 132 includes an offset portion 160 that does not extend into the groove 114 in mandrel 12. This allows the groove 114 to be shorter and resultantly the cone 20 to be shorter axially. Benefits of the arrangement are a shorter overall length of the gripping arrangement in this embodiment while maintaining the antirotation benefit of the foregoing embodiment.

Embodiment 1

A gripping arrangement includes a mandrel having an axially extending groove therein, a first slip ring about the mandrel, a first cone about the mandrel spaced from the first slip ring, a key engaged with the groove such that the key is axially movable and rotationally fixed relative to the mandrel, the key disposed to maintain the spacing between the first slip ring and the first cone, and a release feature releasably interconnected with the key.

Embodiment 2

The gripping arrangement of any prior embodiment, wherein the key includes an offset.

Embodiment 3

The gripping arrangement of any prior embodiment wherein the release feature is a shear element.

Embodiment 4

The gripping arrangement of any prior embodiment, wherein the release feature connects the key to the first slip ring.

Embodiment 5

The gripping arrangement of any prior embodiment, further including a slip interactive with the first slip ring and the first cone.

Embodiment 6

The gripping arrangement of any prior embodiment, wherein the slip is prevented from setting by the key until the release feature releases.

Embodiment 7

The gripping arrangement of any prior embodiment, wherein the groove includes a shoulder configured to drive the kay to unset the gripping arrangement.

Embodiment 8

A gripping arrangement including a mandrel having an axially extending groove herein, a first slip ring about the mandrel, a first cone about the mandrel spaced from the first slip ring, a key engaged with the groove and configured to be loaded to unset the gripping arrangement.

Embodiment 9

A method for setting a gripping arrangement including running the gripping arrangement of any prior embodiment, the arrangement further comprising a second slip ring and, a second cone interactive with the slip ring, actuating the second slip ring and cone while delaying actuation of the first slip ring and cone, releasing the release feature, actuating the first slip ring and the first cone.

Embodiment 10

The method of any prior embodiment, further including deploying a seal.

Embodiment 11

The method of any prior embodiment, wherein the seal is disposed between the first and second cone.

Embodiment 12

The method of any prior embodiment, wherein the seal is a compression element.

Embodiment 13

The method for unsetting a gripping arrangement of any prior embodiment, the arrangement further including a second slip ring and, a second cone interactive with the second slip ring, the method including pulling on the second slip ring and the mandrel, increasing distance the second slip ring and the second cone, shifting the mandrel relative to the key, contacting the key on a shoulder of the groove, moving the first cone with the key away from the first slip ring.

The use of the terms "a" and "an" and "the" and similar referents in the context of describing the invention (especially in the context of the following claims) are to be construed to cover both the singular and the plural, unless otherwise indicated herein or clearly contradicted by context. Further, it should further be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A gripping arrangement comprising:

a mandrel having an axially extending groove therein;

a first slip ring disposed radially outwardly of the mandrel;

a first cone disposed radially outwardly of the mandrel spaced from the first slip ring;

a key engaged with the groove such that the key is axially movable and rotationally fixed relative to the mandrel, the key disposed to maintain the spacing between the first slip ring and the first cone; and a release feature releasably interconnected with the key.

2. The gripping arrangement as claimed in claim 1 wherein the key includes an offset.

3. The gripping arrangement as claimed in claim 1 wherein the release feature is a shear element.

4. The gripping arrangement as claimed in claim 1 wherein the release feature connects the key to the first slip ring.

5. The gripping arrangement as claimed in claim 1 further comprising a slip interactive with the first slip ring and the first cone.

6. The gripping arrangement as claimed in claim 5 wherein the slip is prevented from setting by the key until the release feature releases.

7. The gripping arrangement as claimed in claim 1 wherein the groove includes a shoulder configured to drive the key to unset the gripping arrangement.

8. A method for setting a gripping arrangement comprising:

running the gripping arrangement as claimed in claim 1, the arrangement further comprising a second slip ring and, a second cone interactive with the slip ring;

actuating the second slip ring and cone while delaying actuation of the first slip ring and cone;

releasing the release feature; and actuating the first slip ring and the first cone.

9. The method as claimed in claim 8 further comprising deploying a seal.

10. The method as claimed in claim 9 wherein the seal is disposed between the first and second cones.

11. The method as claimed in claim 9 wherein the seal is a compression element.

12. A method for unsetting a gripping arrangement claimed in claim 1, the arrangement further including a second slip ring and, a second cone interactive with the second slip ring, the method comprising:

pulling on the second slip ring and the mandrel;

increasing a distance between the second slip ring and the second cone;

shifting the mandrel relative to the key;

contacting the key on a shoulder of the groove; and moving the first cone with the key away from the first slip ring.

* * * * *